US005921058A

United States Patent [19]

Brooker

[11] Patent Number: 5,921,058

[45] Date of Patent: Jul. 13, 1999

[54] TOOL FOR APPLYING SHEET SIDING TO BUILDINGS

[76] Inventor: William C. Brooker, 800 Yale St., Englwood, Fla. 34223

[21] Appl. No.: 08/738,850

[22] Filed: Oct. 28, 1996

[51] Int. Cl.[6] ..... B25B 11/00

[52] U.S. Cl. ..... 52/749.1; 52/DIG. 1; 52/127.2; 33/613

[58] Field of Search ..... 52/749.1, DIG. 1, 52/127.2, 127.3, 127.5; 269/43, 315, 904; 33/613, 474, 481, 484, 489

[56] References Cited

U.S. PATENT DOCUMENTS 4,123,846 11/1978 Parras ..... 33/474
4,773,163 9/1988 Wolford ..... 33/474 X
4,930,225 6/1990 Phillips ..... 33/613 X
5,038,487 8/1991 Johnson ..... 33/489 X
5,090,129 2/1992 Cunningham ..... 33/481
5,522,149 6/1996 Meyer ..... 33/646

*Primary Examiner*—Robert Canfield

[57] ABSTRACT

A siding application tool that allows one person to apply sheet siding and sub-siding to a building. A verticle guide plate with slightly bent ends joins a base plate perpendicularly making a shelf onto which sheets of paneling will rest. The tool will be attached temporarily to the bottom corner of fastened sheets to hold the next sheet being applied in position for fastening. The tool will also be used with a spacer to attach the first sheet of paneling in the proper location of the corner of the building.

3 Claims, 3 Drawing Sheets

TOOL FOR APPLYING SHEET SIDING TO BUILDINGS

This invention relates to tools and more particularly to tools that support sheets of siding in position for fastening to the wall of a wooden framed buildings.

In the housing industry, siding and sub-siding in sheet form, such as plywood, pressboard or concrete based panels, is applied to the exterior of the outside stud walls. These panels are in the form of four by eight foot panels that are usually ½ to ⅝ inch thick. Such sheets are awkward to handle and require no less then two workers to align each sheet and to hold it in position while the sheet is fastened to the framing of the building.

It is the object of the present invention to provide a tool which makes it possible to temporarily hold one edge of a sheet of material in aligned possition relative to a building frame and other previously applied sheet . It is thereby possible for a single worker to place a sheet of siding into position for fastening. This would be done more rapidly and accurately then the aformentioned two workers could do it.

OBJECTS AND ADVANTAGES

There were several tools for applying siding but none specifically designed for applying sheet siding. Several objects and advantages of the present invention are ;

(a) to provide a tool that allows one worker to apply sheet siding.

(b) to provide a tool that aligns the edge of the sheet with the center of the proper stud.

(c) to provide a tool that allows the sheet to over-lap the bottom plate easily and consistanly.

(d) to provide a tool that aligns the bottom edge of the sheets relative to one another.

(e) to provide a tool that is virtually indestructable, compact, and low cost.

(f) to provide a tool that can be used by any person in applying sheeting over windows for wind protection.

DISCUSSION OF PRIOR ART

Builders of wood frame structure apply a panel sub-siding or siding to the structure's exterior frame. Such panels may be made of plywood, press-board or cement based composites. Attaching these panels to the buildings has always required at least two workers and aligning the bottom and edges is a difficult job. Inventors have in several cases developed tools that assist workers in applying lap siding so that it can be done by one worker. U.S. Pat. No. 5,522,149 to Meyer (1996) discloses such a tool. This tool could not be used to temporarily hold plywood in position. U.S. Pat. Nos. 5,465,499 to LaPLante (1994) and U.S. Pat. No. 5,408,757 to Lenz (1994) basically do the same job as Meyer's but again neither can be used to temporarily hold panels in position for fastening.

After searching through the internet for related patents of the last twenty years it was impossible to find any invention that addresses the job that the present invention is intended.

Figure 1:
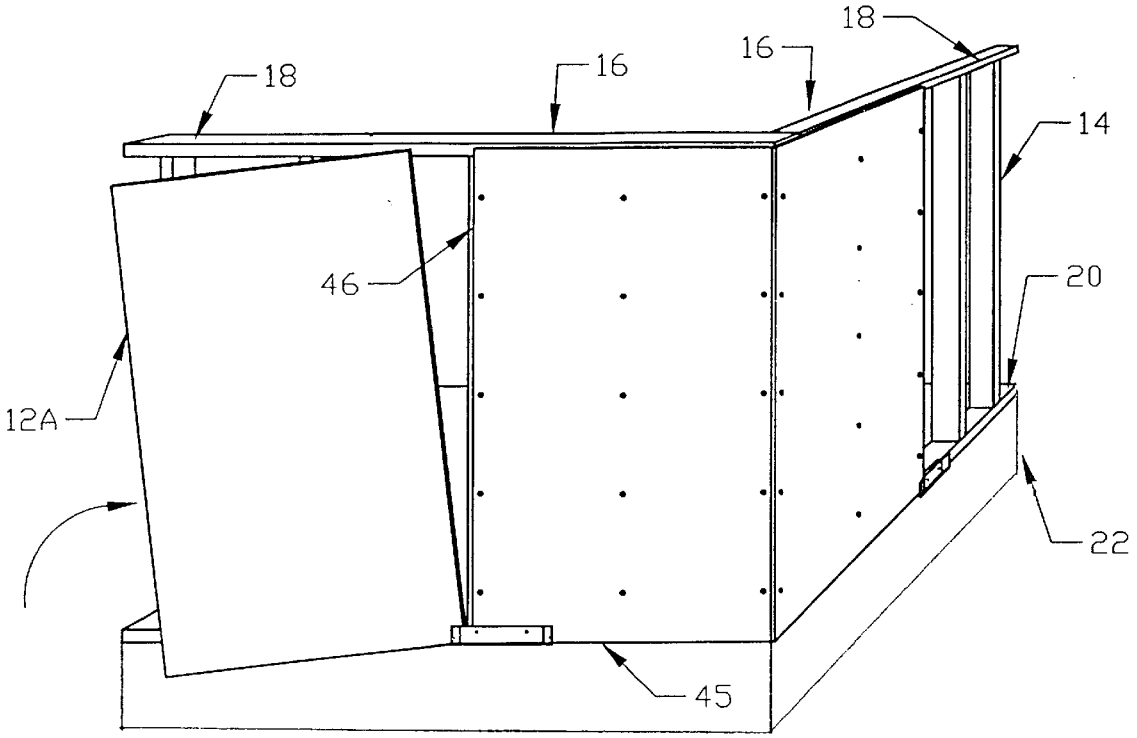
FIG. 1 is a perspective of a wood frame building with a siding tool in a position to start siding (FIG. 1*a*) and siding tool shown in a position to continue siding (FIG. 1*b*).

| Reference Numerals In Drawings | | | |
|---|---|---|---|
| 10 | tool | 12 | siding 12a new sheet |
| 14 | framing stud | 16 | general framing |
| 18 | top plate | 20 | bottom plate |
| 22 | concrete slab | 24–28 | not used |
| 30 | base of tool | 32 | guide plate |
| 34 | guide plate face | 36 | back side of guide plate |
| 38 | bend in guide plate | 40 | surface of bent guide plate |
| 42 | holes | 44 | surface of bottom plate |
| 46 | vertical edge of sheet | 48 | protrusion guide marks |
| 50 | spacer | 52 | horizontal guide marks |

DETAILED DESCRIPTION

The tool 10 of the present invention is particularly adapted for use in the installation or application of sheets 12 to the studs 14. They form part of a house structure designated generally at 16. The portions of the building 16 to which the sheets 12 are attached include the studs 14 which extend between a top plate 18 and a bottom plate 20. The bottom plate 20 is fastened to a cement slab 22 or wood framed flooring (not shown).

The tool has an elongated base 30 and a guide plate 32 formed integrally and perpendicular to the base 30 to form a T- shaped cross section. The guide plate 32 has a face surface 34 and an opposed back surface 36. The ends of the guide plate 32 are bent as indicated at 38, to form guide surfaces designated at 40. The opposite end of the tool is the same. The guide surfaces at 40 form an angle with the surface of the face of 34 of approximately twelve degrees.

The guide plate 32 is provided with two transverse holes 42. These holes receive fasteners such as nails or screws to temporarily hold the tool 10 in position relative to sheet 12 when the tool is being used.

The face 34 of the guide plate 32 is disposed at right angles to the top surface 44 of the base plate 30 and is spaced a uniform distance from the edge of the base 30 slightly less then the thickness of the sheets 16. In actual practice the thickness of sheets 12 are usually ½" to ⅝" thick and the face 34 from the edge of 44*a* of the base is slightly less than ½".

Use of the tool 10 will first be described with reference to its use in connection with the installation of sheets after at least one sheet of siding has been installed.

Referring now to FIG. 1*b* shows placement of the tool 10 upon an already installed sheet. The following method of use will be used on second and all subsequent sheets installed on each side of the building.

Figure 2:
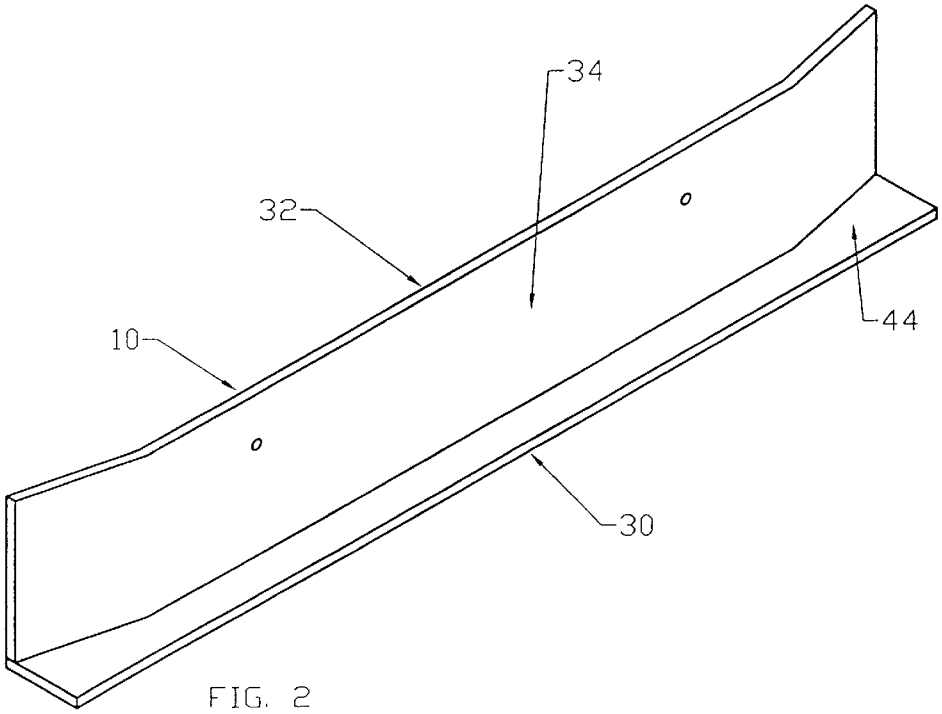
FIG. 2 is a isometric perspective of the tool.
Figure 3:
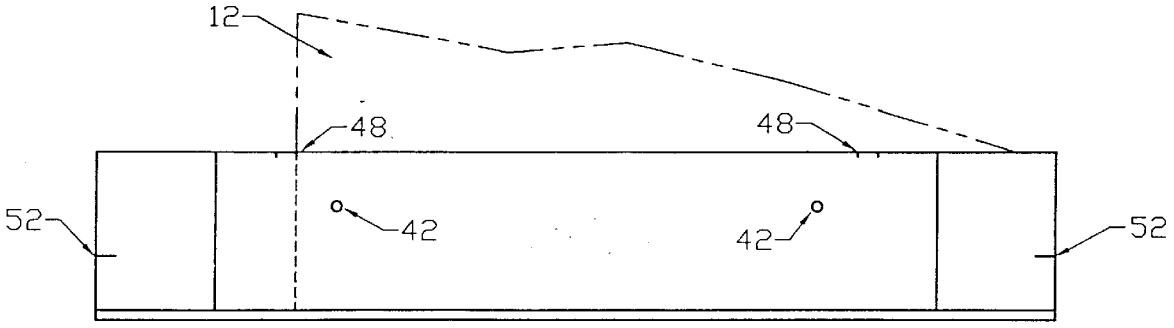
FIG. 3 is a front elevation of the tool shown relative to a sheet of material in the continuing siding position.

The tool 10 is positioned with the top surface 44 on the base 30 adjacent to the bottom or horizontal edge 45 of a sheet which has already been fastened to the framing. One end of the tool 10, including the guide surface 40, is positioned beyond the vertical edge 46*a* of sheet 12. Index marks indicated at 48 in FIG. 2 are scribed on the top edge of guide plate 32 at each end of the tool 10 to indicate how far the end of the tool is to protude past the surface 46*a* of sheet 12. The tool 10 is temporarily fastened to the previously installed sheet with decking screws or duplex (double headed)nails in this position.

Sheet 12*a*, the next sheet to be installed, is placed so that the horizontal bottom edge 45 of one corner of the sheet 12*a* rest on the exposed surface 44 of the tool 10. The exposed guide surface 40 engages the exterior surface of the sheet 12*a* and acts as a cam so that as the sheet 12*a* is urged towards the installed sheet 12, The sheet is guided inwardly against the framing of the building. The opposite edge of the sheet 12*a* is movable by the workman for final alignment. The sheet 12*a* can now fastened to the framing. The tool 10 is now removed from sheet 12 and re-attached to the sheet 12*a* to ready to receive the next sheet to be installed. This process is repeated for each sheet.

Figure 5:
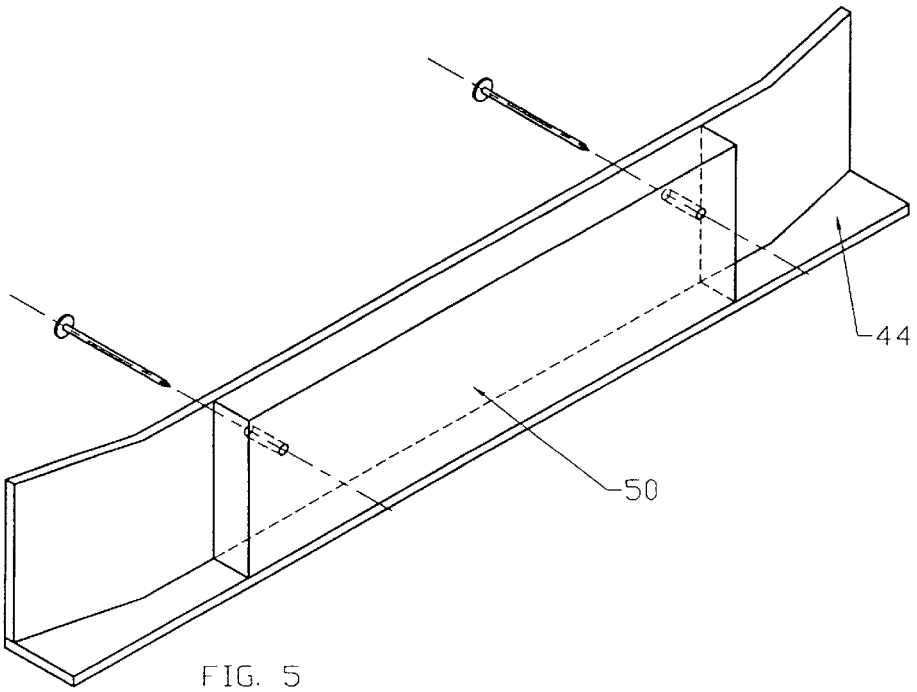
FIG. 5 is a perspective of the tool showing the spacer used when starting the first sheet in position on the tool.
Figure 6:
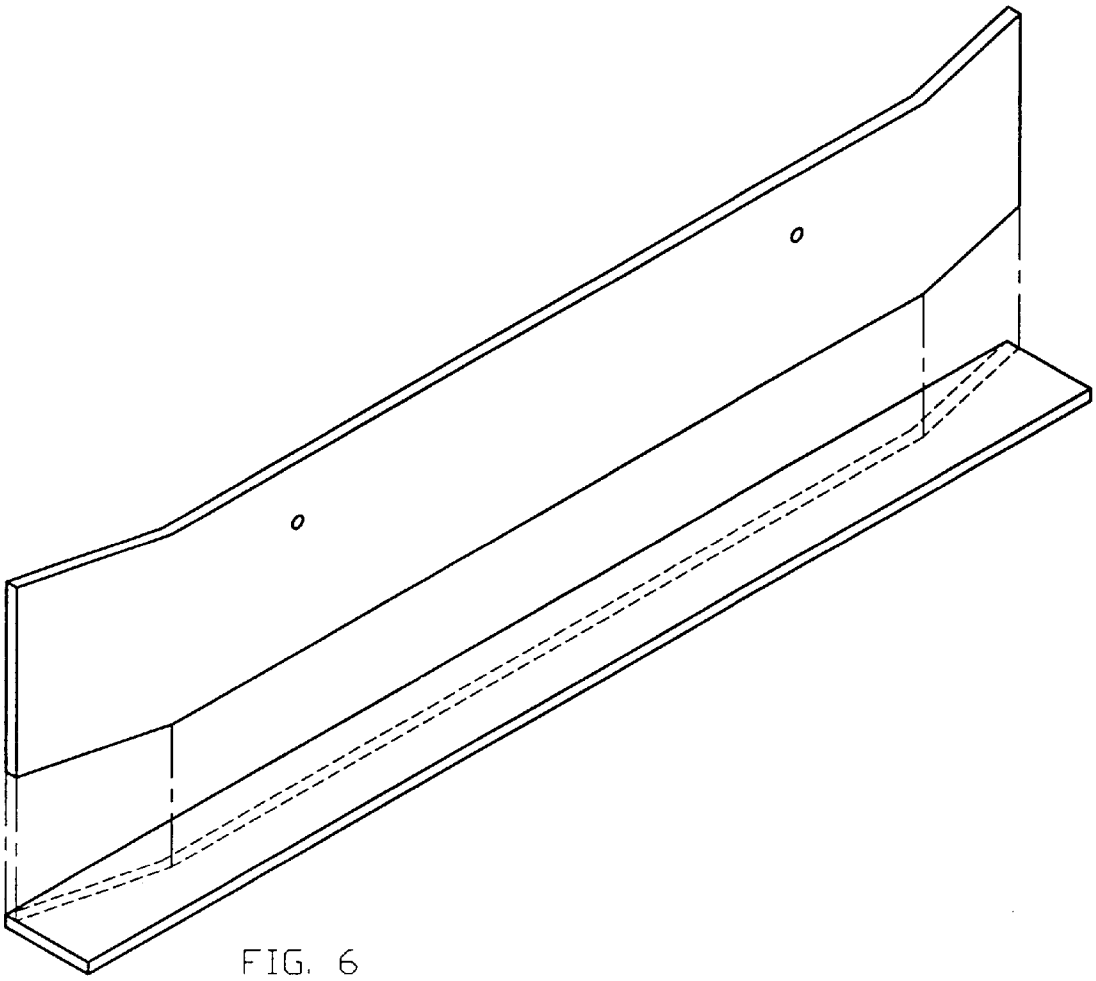
FIG. 6 is a isometric exploded view of the tool.

The first sheet of material can installed on the framing by using the tool 10 and spacer 50 provided with the tool. However any scrap material of the sheets being installed will work. The spacer should be the length of the distance between the scribed marks 48 on the tool 10 and high as the surface 34. FIG. 5 shows the tool 10 with the spacer in position. To attach the first sheet 12 on the side of a structure, attach tool 10 with spacer 50 in position shown in FIG. 5, to the bottom plate. Then tool 10 Should be attached about 48" from the corner such that the horizontal marks 50 are even with the bottom plate and the mark 48 is centered in the center of the closest stud 14. A worker places the sheet 12 onto the shelf 44 and positions the outside corner even with the corner framing and fastens the sheet to the framing. The tool is removed and fastened to the same corner of sheet 12 without the spacer as described earlier.

SUMMARY , RAMIFICATIONS AND SCOPE

Accordingly, the reader will see that this tool will be useful to the professional carpenter as well as the home handyman. It allows a person working alone to "hang" exterior panel siding. The tool more accurately aligns the bottom edges than two persons installing siding in the conventional method. It gives the proper overhang of the siding over the slab or floor.

With the spacer on the tool it is possible for one worker to place the sheet centered properly on the correct stud and plumb with the framing. The tool can also be used for but not limited to the following.

installing storm protection plywood over windows by fastening the tool and spacer in the lower corner of the window.

applying siding to gables of concrete block buildings.

Siding a building in either direction.

Figure 4:
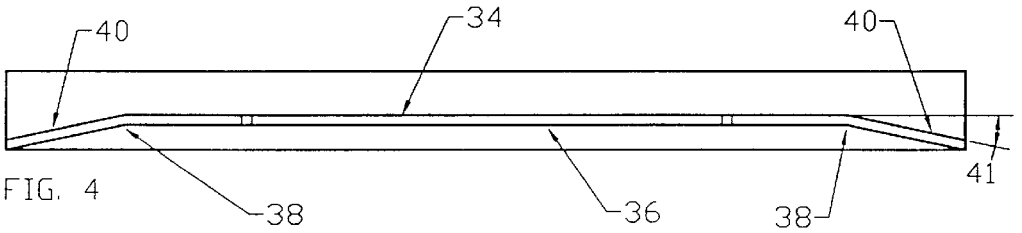
FIG. 4 is a top elevation of the tool showing approximate position of the welds.

The tool is simple to fabricate from two pieces of flat steel stock. The base is approximately 12" by 1" by ⅛". The guide plate is 12" by 2" by ⅛". It is bent on a press at about 1½" from each end to an angle of approximately 12°. The two pieces are then welded together similar to FIG. 4.

I claim:

1. A tool for temporarily holding exterior panels while they are fastened to a framework comprising:

an elongated base; and a guide plate projecting perpendicularly from the base and forming a generally T-shaped cross section therewith, said guide plate having a central portion and two ends, each end having a guide surface bent at angle of approximately 12° with respect to the central portion of the guide plate.

2. The tool of claim 1 wherein the tool is made from one of steel, aluminum, and plastic.

3. The tool of claim 1 wherein said guide plate is provided with two or more holes which fasteners such as nails or screws can be used to temporarily hold the tool in position.

* * * * *